US005518312A

United States Patent [19]

Inoue et al.

[11] Patent Number: 5,518,312

[45] Date of Patent: May 21, 1996

[54] MIXING DEVICE AND METHOD

[75] Inventors: Takao Inoue, Tokyo; Makoto Saito, Kawasaki, both of Japan

[73] Assignee: Kajima Corporation, Tokyo, Japan

[21] Appl. No.: 364,094

[22] Filed: Dec. 27, 1994

[30] Foreign Application Priority Data

Dec. 27, 1993 [JP] Japan ..... 5-330865
Sep. 26, 1994 [JP] Japan ..... 6-230088

[51] Int. Cl.[6] ..... B01F 7/16

[52] U.S. Cl. ..... 366/293; 366/294; 366/296; 366/2; 241/46.17

[58] Field of Search ..... 366/292–296, 366/8, 3, 6, 14, 2; 241/46.17

[56] References Cited

U.S. PATENT DOCUMENTS

| | | | |
|---|---|---|---|
| 1,732,974 | 10/1929 | Laney | 366/296 X |
| 1,796,659 | 3/1931 | Moyer . | |
| 2,298,317 | 10/1942 | Smith | 366/296 X |
| 2,315,251 | 3/1943 | Eppenbach . | |
| 4,403,868 | 9/1983 | Kupka | 366/296 X |
| 4,741,483 | 5/1988 | Damm et al. | 366/296 X |
| 4,786,001 | 11/1988 | Ephraim et al. | 366/296 X |
| 4,789,244 | 12/1988 | Dunton et al. | 366/12 |
| 4,795,263 | 1/1989 | Kaga | 366/8 |
| 4,801,630 | 1/1989 | Chow et al. | 524/5 |
| 5,102,229 | 4/1992 | Wada et al. | 366/294 |
| 5,213,415 | 5/1993 | Saeki | 366/294 |

FOREIGN PATENT DOCUMENTS

| | | |
|---|---|---|
| 378938 | 10/1907 | France . |
| 648783 | 8/1937 | Germany . |
| 178697 | 5/1922 | United Kingdom . |
| 214446 | 5/1924 | United Kingdom . |
| 2158727 | 11/1985 | United Kingdom . |

*Primary Examiner*—Timothy F. Simone
*Assistant Examiner*—Patrick F. Brinson
*Attorney, Agent, or Firm*—Wenderoth, Lind & Ponack

[57] ABSTRACT

Mixing material around an inner agitator in a mixing vessel is urged upward and outward by rotating the inner agitator in one direction. Simultaneously, mixing material around or adjacent an outer agitator is urged downward and inward by rotating the outer agitator in the opposite direction. Consequently, the mixing materials urged upward and downward are caused to be circulated by convection in the mixing vessel and the mixing materials urged outward and inward are caused to collide between the inner and outer agitator, thus forming a high-pressure region between the inner and outer agitator. The mixing materials are mashed in the high-pressure region and well mixed in a short time at high efficiency without being agglutinated to the inner agitator.

12 Claims, 6 Drawing Sheets

MIXING DEVICE AND METHOD

BACKGROUND OF THE INVENTION

1. Field of the Invention

This invention relates to a mixing device and method for effectively stirring or mixing different materials such as raw materials for the manufacture of a variety of concretes.

2. Description of the Prior Art

Mixing devices such as a concrete mixer for mixing cement, water and aggregate to produce cement paste or ready-mixed concrete are commonly divided into three types. One is a vessel-rotating type mixer (so-called vessel-tilting type mixer) comprising a rotary vessel and inner mixing blades fixed inside the mixing vessel. In this vessel-rotating type mixer, the rotary vessel is rotated to mix different materials by use of free fall of the materials in the rotating vessel. Thus, this mixer making use of gravitation is inferior in efficiency.

A second type is a so-called pan-type mixer having a stationary pan-like vessel and a mixing paddle disposed on the axial center of the vessel.

A third type is a horizontal-paddle type mixer having a stationary vessel and one or more rotary mixing paddles horizontally supported in the vessel.

The aforementioned vessel-fixed type mixers are now finding widespread acceptance for actual use. In the concrete mixer of this type, however, mixing materials are mixed with a shearing force produced by rotating the paddles, and therefore, cannot be satisfactorily circulated by convection in the vessel and well mixed in a short time.

There has been a conventional concrete mixer of the vessel-fixed type for mixing powder material such as flour and granular medicines, as shown in FIG. 1. This prior art concrete mixer has a single agitating spiral screw 2 vertically supported in a vessel 4, and a draft cylinder 6 arranged coaxially around the screw 2 so as to circulate the mixing material in the vessel by convection. That is, by rotating the screw 2, the mixing material M in the vessel 4 is caused to move downward inside the draft cylinder 6 and upward outside the draft cylinder 6.

In the case of dealing with sticky mixing materials in the concrete mixer using such a draft cylinder around the screw, however, the mixing material M near the screw 2 and at the inner surface of the vessel 4 tends to be prevented from moving and is stagnated around the regions as indicated by the symbols T1 and T2 in FIG. 1. Consequently, the mixture obtained is insufficiently mixed.

Furthermore, the situation that the sticky mixing material within the draft cylinder 6 is agglutinated to the screw 2 while being mixed becomes a matter of great concern. As a result, the screw 2 is rotated in sympathy with the mixing material, thus bringing about a so-called "racing" phenomenon in which the mixing material in the vessel is not circulated by convection, thus causing the mixer to malfunction practically. The racing phenomenon conspicuously occurs when mixing material having high viscosity.

Also in a dual-screw type mixer having two screws arranged in parallel within a mixing vessel, mixing material admitted into the vessel is apt to lose fluidity around the inner surface of the vessel and to be stagnant. Under certain circumstances, the mixing material is possibly agglutinated to the screws, consequently bringing about the racing phenomenon causing the mixer to malfunction practically.

Thus, conventional concrete mixers of all types have a common disadvantage such that they cannot uniformly stir or mix different mixing materials with a high efficiency and are apt to give rise to the racing phenomenon in which the mixing materials are agglutinated to and rotated together with the rotating screw or screws.

Considering the case of cement paste for light-weight concrete or aerated concrete by way of example, the insufficient mixing as noted above entails a problem of bringing forth small cement bubbles in the cement paste. The cement bubbles in the cement paste result in defects on the micron order in hardened concrete, thus lowering the strength of the concrete. Although the mixing materials should be sufficiently mixed to obviate such problems and obtain concrete products of high quality, it has been desired to enhance the efficiency of production of the cement paste so as to produce cement paste in a short period of time in large quantities in view of productivity.

OBJECT OF THE INVENTION

This invention is made to eliminate the drawbacks suffered by the conventional mixing devices described above and has as an object to provide a mixing device and method capable of swiftly stirring or mixing different kinds of materials at high efficiency without causing the mixing materials to be agglutinated to agitating means or stagnated in a mixing vessel, thus producing a high quality mixture in which the raw materials are uniformly dispersed.

Another object of the invention is to provide a mixing device having inner and outer agitating means coaxially arranged and means for effectively driving the agitating means in opposite directions in order to swiftly and uniformly stir or mix various kinds of materials at high efficiency.

SUMMARY OF THE INVENTION

To attain the objects described above according to this invention, there is provided a mixing device comprising a mixing vessel, inner and outer agitating means coaxially arranged in the mixing vessel, and driving means for rotating the inner and outer agitating means in opposite directions so as to cause mixing materials around or adjacent the respective inner and outer agitating means to flow in opposite directions and to collide with each other at a middle portion or region between the inner and outer agitating means.

Furthermore, the present invention provides a mixing method comprising rotating inner and outer agitating means in opposite directions to stir mixing materials in a vessel so as to cause the mixing materials around or adjacent the respective inner and outer agitating means to flow in opposite directions and to collide with each other at the middle portion or region between the inner and outer agitating means.

The mixing material around the rotating inner agitating means is urged upward and outward, and the mixing material around or adjacent the rotating outer agitating means is urged downward and inward. The mixing materials thus urged centrifugally and centripetally come into collision with each other at the middle portion or region between the inner and outer agitating means to form a high-pressure region thereat. In the high pressure region, the particles of the mixing materials undergo shearing friction which positively exerts a mashing action on the mixing materials. As a result, a well-blended mixture having no particle bubbles can be obtained.

The inner agitating means is formed of a screw having a spiral blade inclined in one direction. By rotating the screw in one direction, the mixing material around the screw acquires upward and centrifugal propulsive forces.

The outer agitating means includes agitator vanes each having a forwardly-bent upper portion and an oblique lower portion. By rotating the agitator vanes along the inner surface of a vessel in the direction opposite to the direction in which the inner agitating means rotates, the mixing material around or adjacent the orbit of the agitator vanes along the inner surface of the vessel acquires downward and centripetal propulsive forces.

In addition, the outer agitating means may be provided with rectifier plates which revolve along with the outer agitating means to heighten the effect of circulating the material in the vessel by convection.

Thus, by rotating the inner and outer agitating means in opposite directions at a time, the materials at the central portion and peripheral portion of the vessel are urged toward the middle portion or region thereof and come into collision with each other, resulting in formation of the aforementioned high-pressure region. Owing to the high-pressure region, the mixing materials no longer are agglutinated to the inner or outer agitating means. Therefore, according to the mixing device of the invention, different kinds of mixing materials can effectively be mixed in a short time, and a well-blended high-quality mixture can be produced at high efficiency.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The present invention will become more fully understood from the detailed description given hereinbelow and the accompanying drawings which are given by way of illustration only, and thus are not limitative of the present invention.

The mixing device of this invention is very useful for stirring or mixing different materials to obtain a high quality mixture at high efficiency. The materials to be mixed with this mixing device are by no means limitative and any kind of materials may be dealt with. However, the mixing device and method of this invention will be described hereinafter on the assumption that raw materials for concrete products, including cement, aggregate and water, are used as the mixing material by way of example.

Figure 2:
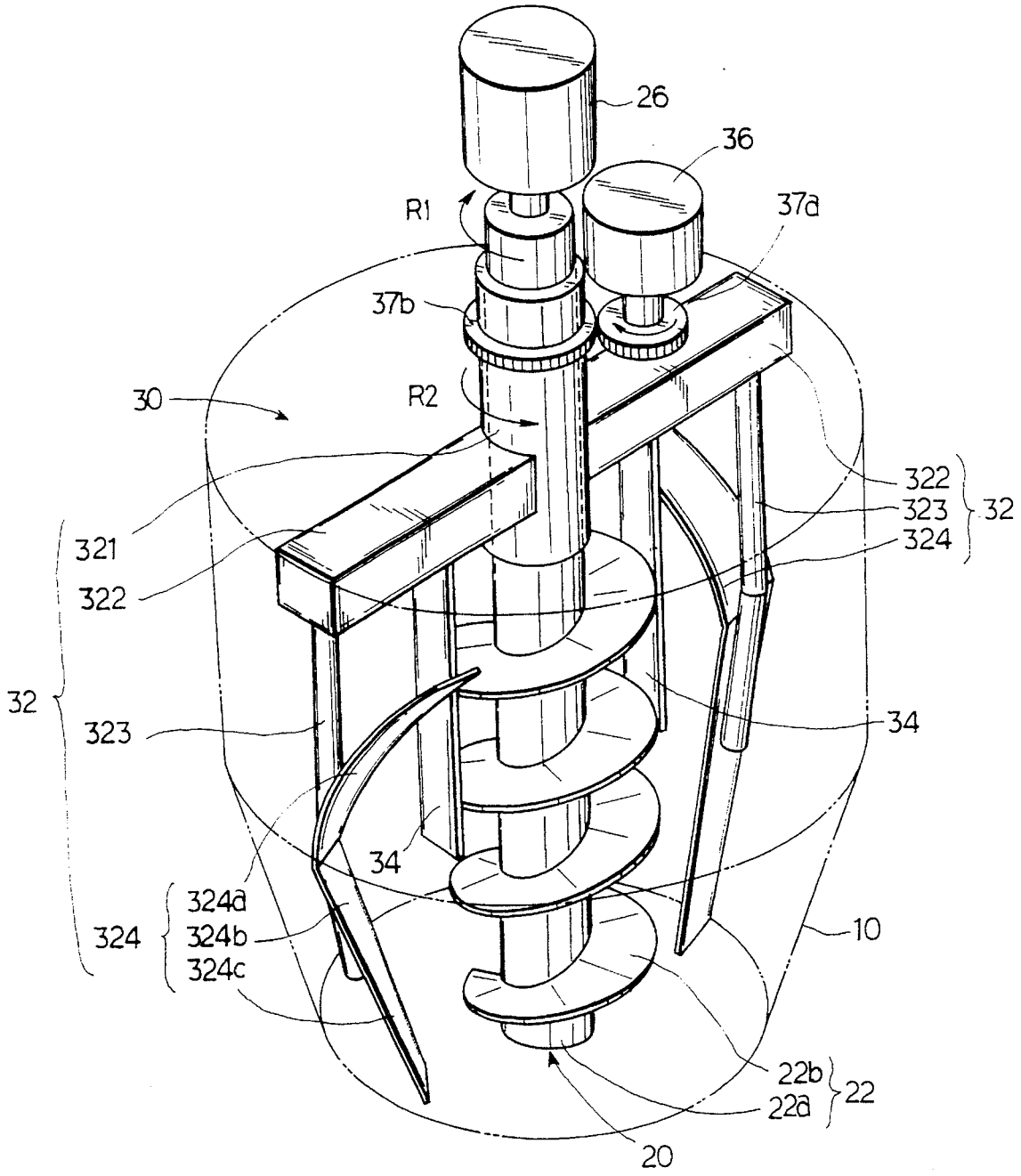
FIG. 2 is a schematic perspective view showing one embodiment of a mixing device of this invention.
Figure 3:
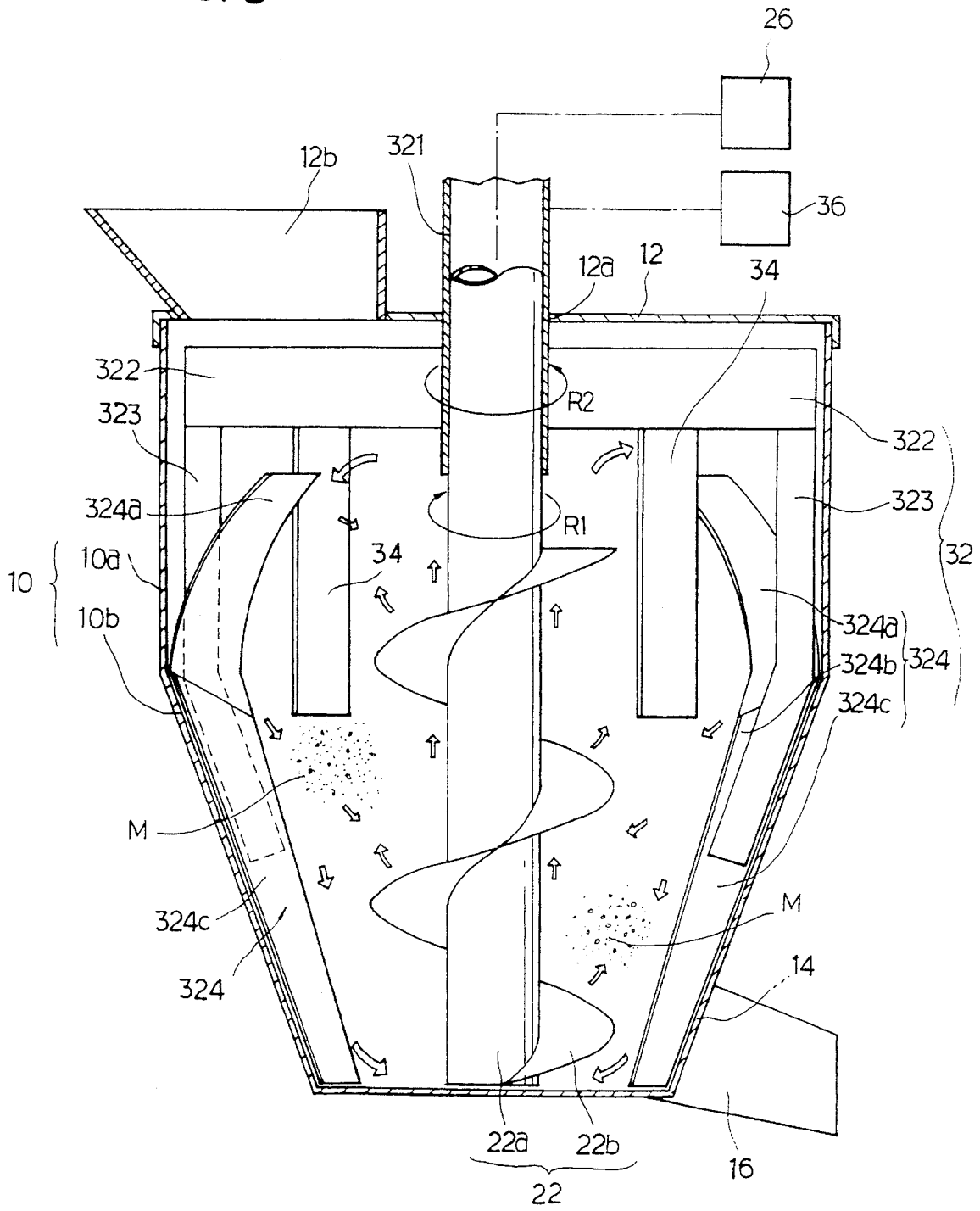
FIG. 3 is a schematic side sectional section showing the device of FIG. 2.
Figure 4:
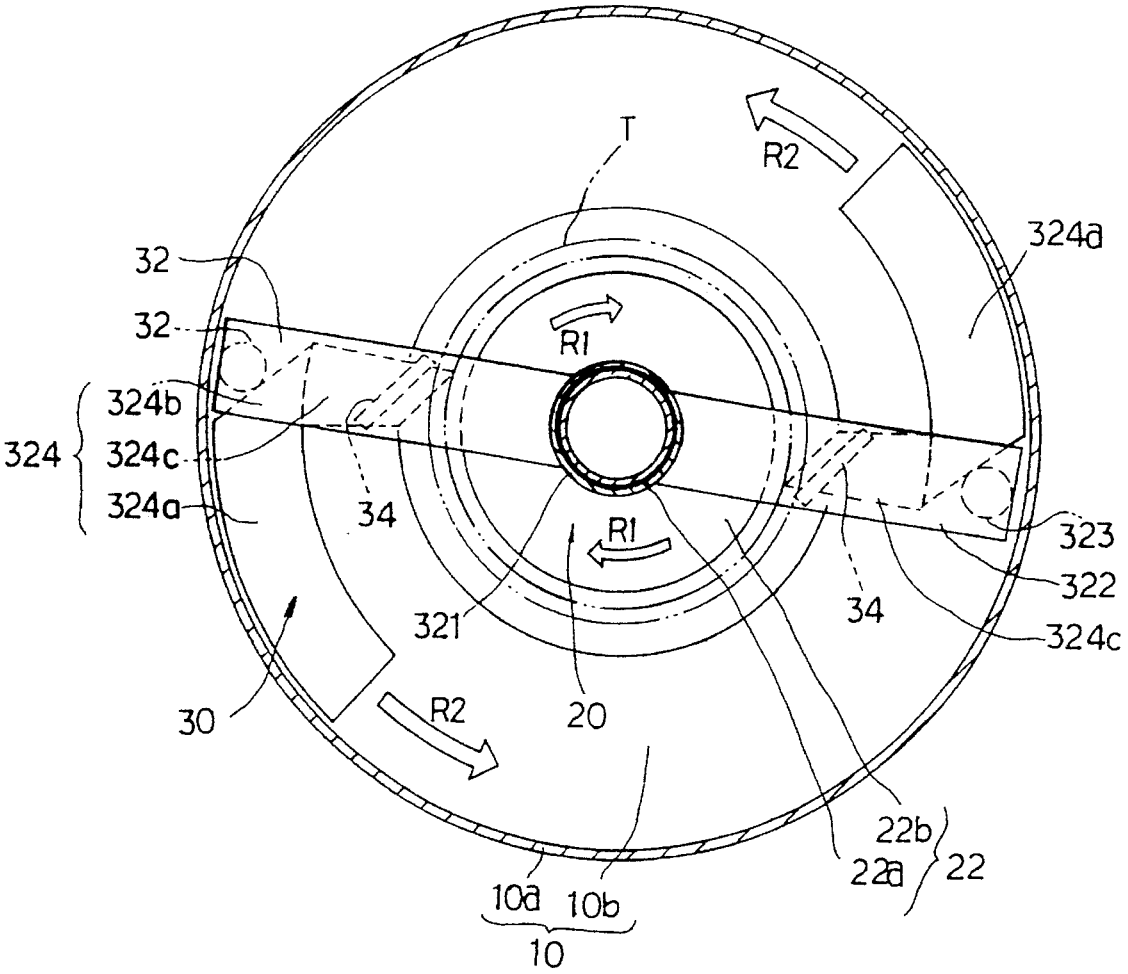
FIG. 4 is a schematic plan sectional view of the device of FIG. 2.

The mixing device shown in FIGS. 2 through 4 as one embodiment comprises a substantially cylindrical mixing vessel 10 into which mixing materials are admitted, inner agitating means 20 rotatably arranged vertically at the center of the mixing vessel 10, and outer agitating means 30 arranged rotatably along the inner surface of the circumferential wall of the mixing vessel 10.

The mixing vessel 10 assumes a generally cylindrical shape comprising a substantially cylindrical upper part 10*a* having an upper opening, and an inverted truncated cone shaped lower part 10*b*. The upper opening of the vessel 10 is covered with a lid member 12 having an axial hole 12*a* and a material inlet surrounded by a hopper 12*b*. The mixing vessel 10 has an outlet 14 and a gutter 16 for discharging a mixture resultantly produced in the vessel.

The inner agitating means 20 has a screw 22 comprising a rotary shaft 22*a* arranged vertically through the axial hole 12*a* in the lid member 12, and a spiral blade 22*b* spirally wound around the rotary shaft 22*a*. The spiral blade 22*b* in this embodiment turns round the rotary shaft 22*a* leftwardly, or counter-clockwise from an axial end of shaft 22*a*, like a right hand screw. Therefore, by rotating the screw 22 rightwardly or clockwise (in the direction indicated by the arrow R1 in FIG. 3), the mixing material M around the screw 22 in the mixing vessel 10 is urged upward. Screw 22 extends throughout the height of material M in vessel 10. Blade 22*b* is solid from shaft 22*a* radially outwardly.

At the time the mixing material M is stirred and urged upward by rotating the screw 22, it is incidentally urged centrifugally. Consequently, the material M in the vessel 10 flows upward as indicated by the arrow f1 in FIG. 5 and simultaneously in the centrifugal direction as indicated by the arrow f2.

Although the screw 22 in this embodiment is formed like a right hand screw, it may be formed like a left hand screw as a alternative. In the case of a left hand screw, the screw 22 may be rotated in the reverse direction to urge the mixing material upward.

The inner agitating means 20 is driven by driving means 26 including an electric motor, which is mounted on the top of the rotary shaft 22*a*.

The outer agitating means 30 comprises rotary units 32 which revolve along the inner surface of the vessel 10 to urge the mixing material in the vessel 10 in the downward and centripetal directions, and rectifier plates 34 attached to each rotary unit 32 so as to revolve along with the rotary units 32 to urge centripetally the material in the vessel 10.

The rotary unit 32 is formed so as to cause the mixing material M in the vessel 10 to flow in a direction opposite to that in which the mixing material around the screw 22 is urged by the inner agitating means 20.

Figure 5:
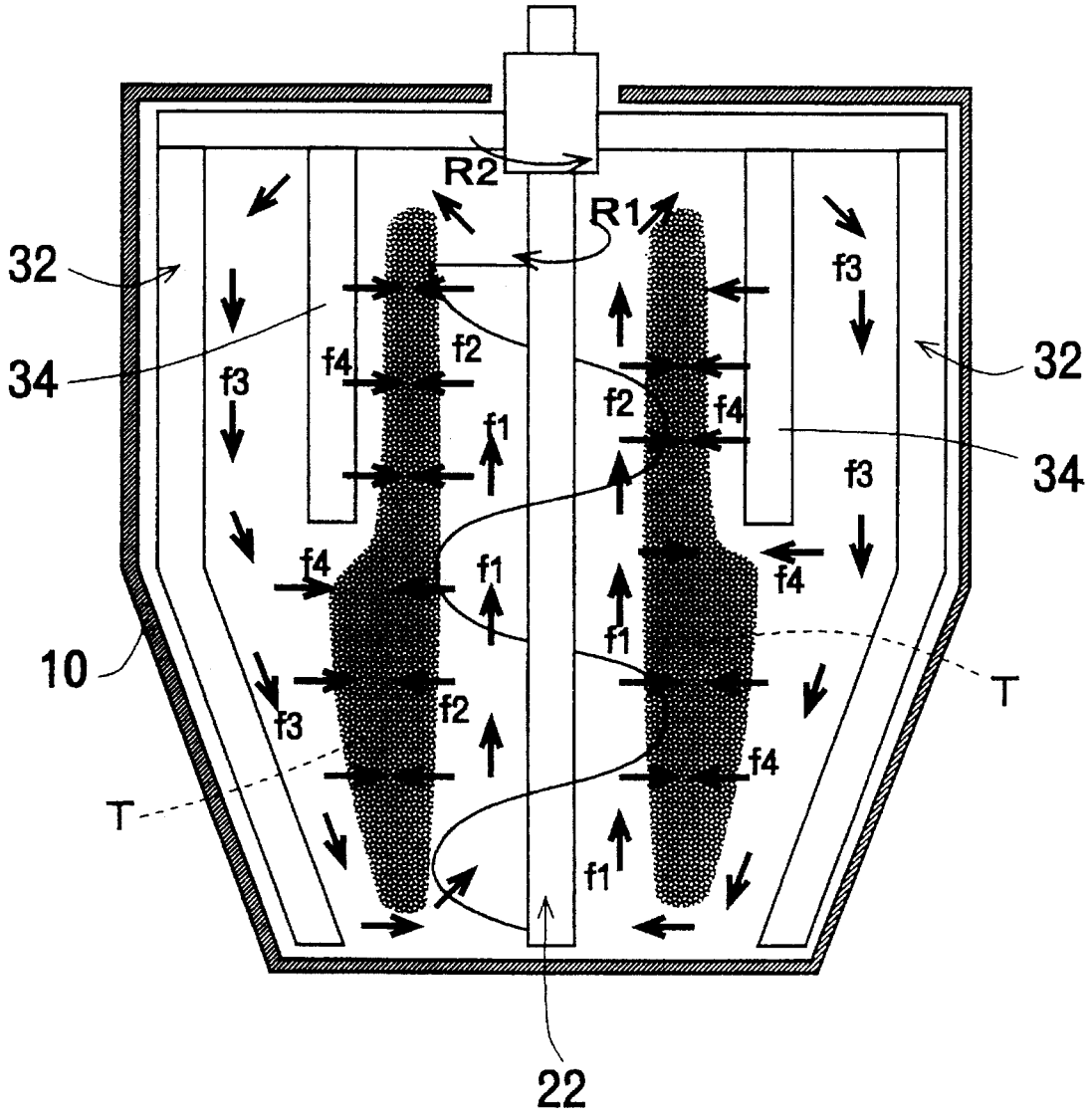
FIG. 5 is a conceptual sketch showing the state in which mixing materials are circulated by convection in the mixing device of the invention.

That is, the inner agitating means 20 causes the mixing material M to flow upward (f1) and centrifugally (f2), and at the same time, the outer agitating means 30 causes the mixing material to flow downward (f3) and centripetally (f4) as shown in FIG. 5.

The rotary unit 32 in this embodiment comprises a cylindrical rotary shaft 321 coaxially arranged around the rotary shaft 22*a* of the screw 22, a pair of rotary arms 322 horizontally extending radially from the rotary shaft 321, supporting rods 323 vertically extending from the rotary arms 322, and agitator vanes 324 held by the supporting rods 323.

The agitator vane 324 is formed of a plate having an upper portion 324*a* bent forward relative to the direction in which the rotary unit 32 revolves, a middle portion 324*b* at which the agitator vane is attached to the supporting rods 323, and an oblique lower portion 324*c* which is inclined relative to the radial direction so as to urge the material in the vessel 10 centripetally when rotating the agitator vane. Vanes 324 extend throughout the height of material M in vessel 10.

The rectifier plate 34 is disposed in a space between the screw 22 and the agitator vane 324 so as to impart a centripetal motion to the mixing material in the vessel. However, if there is no space between the screw 22 and the agitator vane 324, the rectifier plate 34 may be omitted.

The outer agitating means 30 is driven by acquiring rotation from driving means 36 including an electric motor through transmission means 37*a* and 37*b* such as gears.

Figure 1:
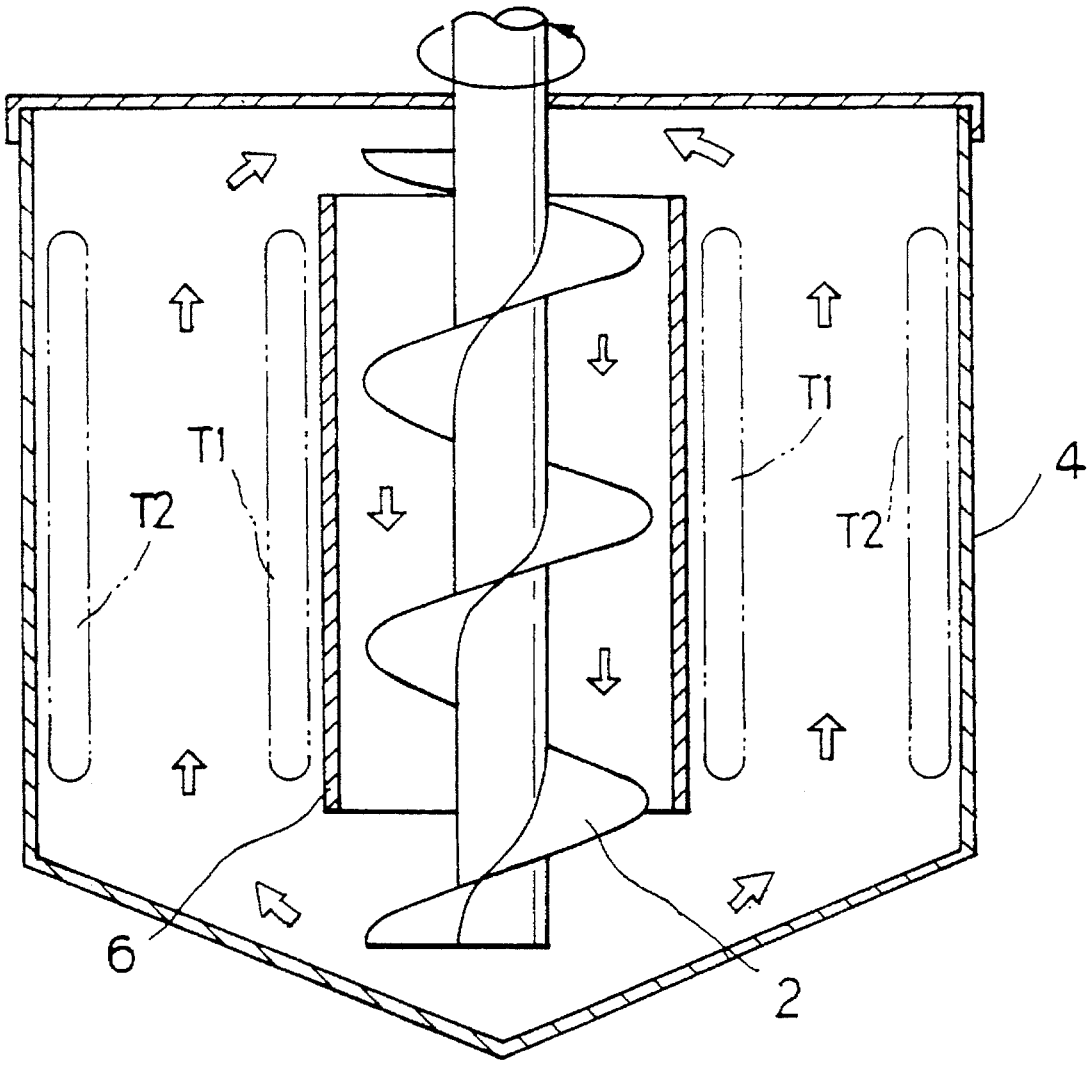
FIG. 1 PRIOR ART
FIG. 1 is a schematic side sectional view showing a prior art mixing device.

Although the driving means 26 for the inner agitating means 20 and the driving means 36 for the outer agitating means 30 have respective separate electric motors as illustrated in FIG. 1, this structure should not be understood as limitative. That is, both driving means may be operated by a single electric motor.

Next, the operation of the aforementioned mixing device of this invention will be explained.

The mixing material M admitted in the mixing vessel 10 is stirred by rotating the inner agitating means 20 and the outer agitating means 30 in the opposite directions in such a state that the material around the rotating screw 22 is urged upward (f1) and centrifugally (f2), and simultaneously, the material around the rotary unit 32 is urged downward (f3) and centripetally (f4) as shown in FIG. 5. The centripetal force exerted on the mixing material is increased by the rotating rectifier plate 34.

Thus, the mixing material M is circulated by convection in the vessel 10, giving rise to a recirculation or convection current of the material. At the same time, the material forcibly moving outwardly from the central portion comes into collision with the mixing material forcibly moving inwardly from the peripheral portion in the vessel, consequently forming a substantially annular high-pressure region T at a middle portion between the central region of the vessel and the peripheral portion thereof, as shown in FIG. 5. In this high-pressure region T, the mixing material M undergoes strong shearing friction repeatedly, and is intensely mashed to cause the particles of the mixing material to be intimately merged together.

Moreover, repulsion brought about as a reaction force of collision of the mixing materials in the high-pressure region T acts on the material held by the spiral blade 22*b* of the screw 22, thereby to heighten fluidity of the mixing material. As a result, the mixing material tending to be stagnant in the spiral blade 22*b* is forced upward, and therefore is prevented from being agglutinated to and rotated together with the screw 22.

Besides, since the rotary units 32 revolve along the inner surface and bottom of the cylindrical vessel 10, the mixing material M is positively moved all over the inside of the vessel 10 to be circulated by convection, resulting in production of a well-blended high-quality mixture.

Since the inner agitating means and the outer agitating means can be operated at different speeds in accordance with the quality and properties of the material to be mixed, a most suitable mixing condition can be established.

The inventors of this invention produced some mixing devices according to the present invention by way of trial and carried on experiments to confirm the superior performance of the mixing device of this invention. Comparative experiments were made using the mixing device of this invention, which comprises a mixing vessel of 650 mm in diameter and 750 mm in height, and a screw having an outer diameter of 240 mm, a spiral blade of 140 mm in width and a diametral pitch of 1:1. As a comparative conventional mixer, a forced two-axle type concrete mixer having two agitating screws and a vessel having the substantially same volume as the mixing device of this invention was used.

Three sets of raw materials for concrete admitted into the respective vessels of the mixer of this invention and the comparative mixer in these experiments are shown in Table 1 below. That is, comparative raw materials #CS1~#CS3 were mixed by the comparative conventional mixer, and sample raw materials #ES1~#ES3 were mixed by the mixing device of this invention. Portland cement was used in the experiments.

TABLE 1

| Sample | Design Slump (mm) | Water/ Cement Ratio (%) | Raw Materials [Unit Volume (kg/m)] Cement | Water | Fine Aggregate | Coarse Aggregate |
|---|---|---|---|---|---|---|
| #CS1 | 18 | 58 | 314 | 182 | 823 | 954 |
| #CS2 | 12 | 58 | 300 | 174 | 820 | 988 |
| #CS3 | 8 | 58 | 279 | 162 | 826 | 1034 |
| #ES1 | 18 | 58 | 309 | 179 | 828 | 959 |
| #ES2 | 12 | 58 | 297 | 172 | 823 | 994 |
| #ES3 | 8 | 58 | 276 | 160 | 823 | 1039 |

In the experiments, the mixer of this invention was operated by rotating the screw 22 at 300 rpm, and simultaneously, the rotary unit 32 at 30 rpm in opposite directions to mix the designated raw materials for concrete. On the other hand, the conventional mixer was operated by rotating the screws at 45 rpm. Each set of the raw materials was mixed continuously until its design slump was obtained.

The times required to obtain cement paste samples having the design slump values for the respective raw materials were determined in advance after repeating tests. Namely, it was found that the conventional mixer requires 60 seconds to obtain the design slumps, and the mixer of this invention requires 15 seconds to obtain the same design slumps. The comparative experiments were conducted by using the cement paste samples produced by mixing the designated materials for the respective prescribed times. The characteristics of the resultant cement paste samples (compressive strength of hardened concrete after specified days) are shown in Table 2 below.

TABLE 2

| Sample | Mixing Time (sec) | Slump (cm) | Compressive Strength (kgf/cm) Age (7 days) | Age (28 days) |
|---|---|---|---|---|
| #CS1 | 60 | 17.5 | 250 | 370 |
| #CS2 | | 13.0 | 242 | 377 |
| #CS3 | | 8.0 | 253 | 385 |
| #ES1 | 15 | 17.5 | 251 | 386 |
| #ES2 | | 11.5 | 255 | 389 |
| #ES3 | | 8.0 | 258 | 399 |

It is clear from the results of the experiments as shown in Table 2 that the cement paste produced by mixing the designated materials for only 15 seconds with the mixer of this invention has strength equal to or higher than that produced by mixing substantially the same materials for 60 seconds with the conventional concrete mixer.

Furthermore, cement paste was produced by mixing raw materials for concrete with a foaming agent in order to back up the excellent characteristics of the cement paste produced by the mixer of the present invention. As a result, a cement paste having a great number of minute bubbles uniformly dispersed therein could be obtained in a short time and turned into high-quality foamed lightweight concrete which is not permeably by water.

Still further, the mixing raw materials were mixed with the foaming agent and a high-performance water reducing agent. As a result, cement paste in which innumerable microscopic bubbles of the order of ten-odd μm in size are dispersed uniformly could be obtained.

In another experiment, toughened staple fibers of about 14 μm in diameter and about 6 mm in length were added to the raw materials and mixed by the mixing device of this invention. It was confirmed that the toughened staple fibers are uniformly dispersed by a ratio of more than 1% in one liter of the cement paste resultantly obtained in spite of the staple fiber being about 428 in aspect ratio. After forming and curing the cement paste thus obtained, fiber-reinforced superduty concrete in which the toughened staple fibers are uniformly dispersed could be produced.

When the raw materials for concrete were mixed with the foaming agent, water reducing agent, and staple fibers, high-quality cement paste possessing the respective excellent characteristics of these additives could be obtained. Thus, by use of the mixing device according to the present invention, even materials which are frequently either impossible or very difficult to mix with the conventional mixing devices can be easily mixed at high efficiency, consequently producing cement paste of high quality.

Although the aforementioned mixing device of the invention has two rotary units 32 each extending horizontally from the cylindrical rotary shaft 321, three or more rotary units may be employed as long as balance of the overall rotary unit 32 is maintained.

Figure 6:
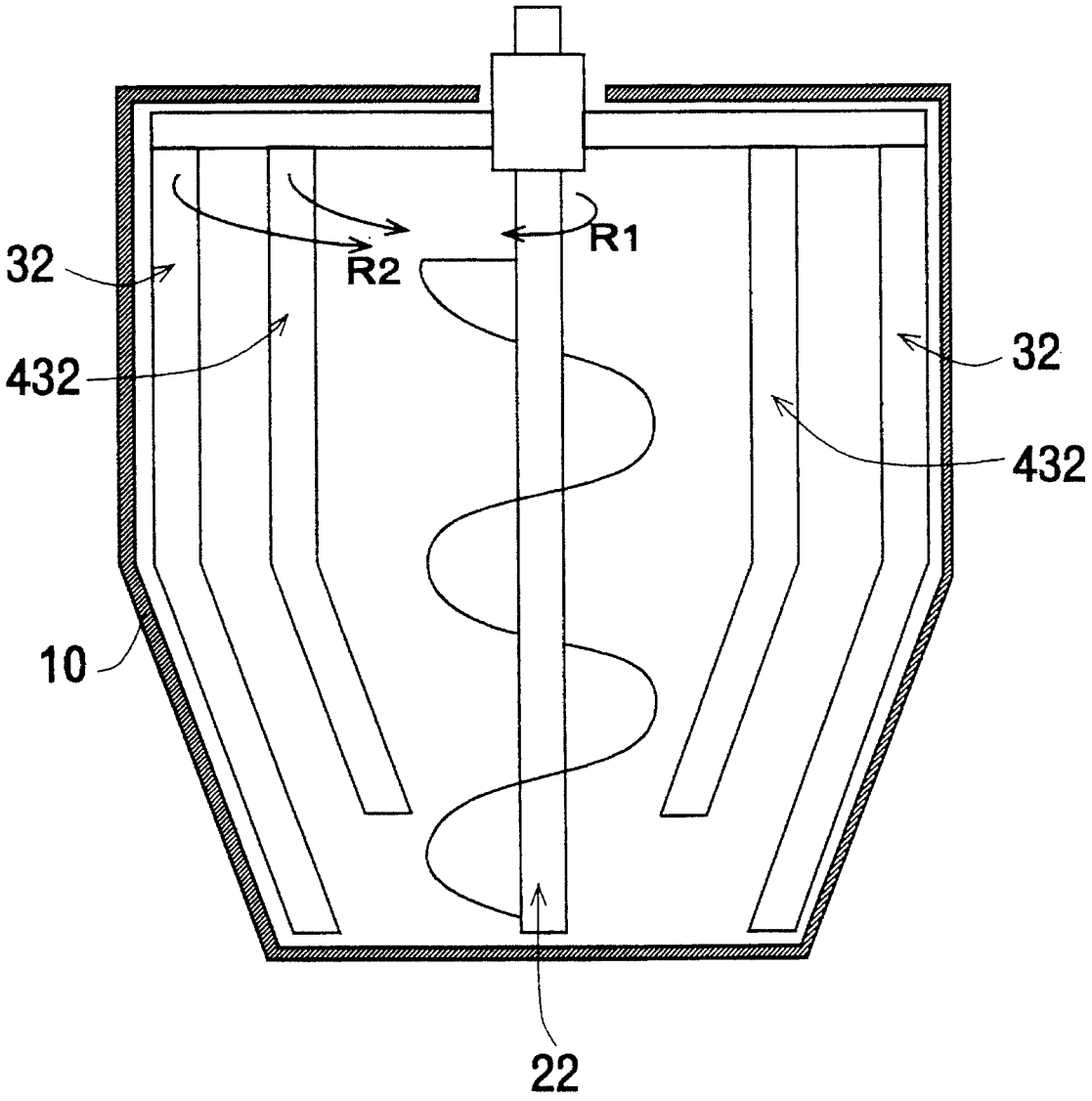
FIG. 6 is a schematic side sectional view of another embodiment of a mixing device according to this invention.

FIG. 6 shows a modified embodiment in which additional rotary units 432 having the same structure as the rotary units 32 may be attached to the rotary arm 322 in place of the rectifier plates 34 used in the foregoing embodiment. By rotating the rotary units 32 together with the additional rotary units 432 in the direction R2 opposite to the direction R1 in which the screw 22 rotates, the shearing friction brought about by the collision of the mixing materials at the high-pressure region between the inner and outer agitating means can be increased to enhance the mixing efficiency.

Incidentally, the constituent elements such as the screw, agitator vanes and rectifier plates may be made not only of metal, but also of plastic, ceramic or any other hard materials.

As is apparent from the foregoing description, according to the mixing device of the present invention, since the mixing materials admitted in the mixing vessel can be effectively recirculated or circulated by convection in the vessel while causing collisions among the particles of the materials, a high-quality mixture in which the particles are uniformly dispersed can be produced in large quantities in a short time at high efficiency. Since the repulsion or reaction of the collisions among the particles of the mixing materials at the high-pressure region in the vessel is exerted to the materials around the screw, the materials are circulated by convection in the vessel without being agglutinated to the screw and stagnated in the spiral blade of the screw. Besides, the collisions among the particles of the mixing materials give rise to strong shearing friction among the particles of the materials, thereby intensely mashing bubbles of particles in the mixture. In particular, the mixing device of the invention is adapted for producing cement paste for lightweight concrete, and can mix all types of materials because the inner and outer agitating means can be separately driven at different speeds in accordance with the quality and property of the mixing materials.

Although the invention has been described in its preferred form with a certain degree of particularity, it is understood that the present disclosure of the preferred form may be changed in the details of construction and the combination and arrangement of parts may be resorted to without departing from the spirit and the scope of the invention as hereinafter claimed.

What is claimed is:

1. A mixing device comprising:

a substantially cylindrically mixing vessel having an interior for containing therein materials to be mixed, said interior having a radially center portion and a peripheral portion radially outwardly of said center portion;

an inner agitating means including a vertical rotary shaft located at a center axis of said vessel and a spiral blade spirally wound about said shaft and integral therewith, said spiral blade extending throughout substantially the entire axial height of a portion of said vessel interior within which the materials are to be contained, and said spiral blade being solid radially outwardly from said shaft;

an outer agitating means including a rotary cylindrical shaft arranged coaxially about said shaft, a pair of arms extending radially horizontally outwardly from said cylindrical shaft, support rods extending downwardly from respective said arms, and agitator vanes mounted on respective said support rods, each said agitator vane having a height extending throughout substantially said entire axial height of said portion of said vessel interior, each said agitator vane comprising an upper portion bent forwardly relative to a direction of rotation of said outer agitating means, a middle portion attached to the respective said support rod, and an oblique lower portion inclined radially inwardly;

driving means for rotating said inner agitating means in a first direction and for rotating said outer agitating means in a second direction opposite to said first direction; and said inner and outer agitating means being configured and relatively positioned such that, upon rotation thereof in said respective first and second directions, said inner agitating means urges all of the materials in said center portion upwardly and said outer agitating means urges the materials in said peripheral portion downwardly, thereby creating a recirculating flow of the materials within said vessel interior, and simultaneously said inner agitating means urges the materials in said center portion radially outwardly and said outer agitating means urges the materials in said peripheral portion radially inwardly, thereby causing the radially outwardly moving materials and the radially inwardly moving materials to collide intensely between said inner and outer agitating means and to thus generate a substantially annular high-pressure region of the materials radially between said inner and outer agitating means.

2. A mixing device as claimed in claim 1, wherein said vessel includes an upper cylindrical upper part and a truncated conical lower part, and said oblique lower portion of each said agitator vane is inclined downwardly and inwardly in a direction substantially parallel to said lower part of said vessel.

3. A mixing device as claimed in claim 2, wherein said oblique lower portion of each said agitator vane extends in a plane that is inclined obliquely rearwardly and inwardly of a radial plane, relative to said second direction, thereby forming means facilitating said urging inwardly of the materials.

4. A mixing device as claimed in claim 1, wherein said outer agitating means further comprises rectifier plates extending downwardly from respective said arms at positions radially inwardly of respective said agitator blades.

5. A mixing device as claimed in claim 4, wherein each said rectifier plate extends in a plane that is inclined obliquely rearwardly and inwardly of a radial plane, relative to said second direction, thereby forming means facilitating said urging inwardly of the materials.

6. A method for mixing materials, said method comprising:

introducing materials to be mixed into an interior of a substantially cylindrical mixing vessel, said interior having a radially center portion and a peripheral portion radially outwardly of said center portion, said vessel including at said center portion an inner agitating means including a vertical screw extending throughout substantially the entire axial height of said materials to be mixed within said vessel interior, and said vessel including at said peripheral portion an outer agitating means arranged coaxially of said inner agitating means and including agitator means extending throughout substantially said entire axial height of said materials to be mixed within said vessel interior; and rotating said inner and outer agitating means in opposite directions within said vessel interior, thereby causing said inner agitating means to urge all of said materials in said center portion upwardly and causing said outer agitating means to urge said materials in said peripheral portion downwardly, thus creating a recirculating flow of said materials within said vessel interior, and simultaneously thereby causing said outer agitating means to urge said materials in said center portion radially outwardly and causing said outer agitating means to urge said materials in said peripheral portion radially inwardly, such that said radially outwardly moving materials and said radially inwardly moving materials intensely collide between said inner and outer agitating means and thus generate a substantially annular high-pressure region of said materials radially between said inner and outer agitating means.

7. A method as claimed in claim 6, comprising rotating said inner and outer agitating means at different speeds.

8. A method as claimed in claim 6, wherein said materials comprise cement, water, fine aggregate and coarse aggregate.

9. A method as claimed in claim 6, wherein said materials comprise cement, water, fine aggregate, coarse aggregate, and a foaming agent.

10. A method as claimed in claim 6, wherein said materials comprise cement, water, fine aggregate, coarse aggregate, and a water reducing agent.

11. A method as claimed in claim 6, wherein said materials comprise cement, water, fine aggregate, coarse aggregate, and staple fibers.

12. A method as claimed in claim 6, wherein said materials comprise cement, water, fine aggregate, coarse aggregate, and at least one of a foaming agent, a water reducing agent, and staple fibers.

* * * * *